US006403930B2

(12) United States Patent
Deo et al.

(10) Patent No.: US 6,403,930 B2
(45) Date of Patent: Jun. 11, 2002

(54) MODULAR RADIANT HEATING UNIT HAVING A THERMALLY INSULATING GASKET AND METHODS OF ASSEMBLING SAME

(75) Inventors: Subhash R. Deo, Northport, AL (US); Jeffrey A. Bates, Starkville, MS (US); Byron N. Cantrell, Beaverton, AL (US); Christopher R. Taylor, Columbus, MS (US)

(73) Assignee: Emerson Electric Co., St. Louis, MO (US)

( * ) Notice: Subject to any disclaimer, the term of this patent is extended or adjusted under 35 U.S.C. 154(b) by 0 days.

(21) Appl. No.: 09/804,827

(22) Filed: Mar. 13, 2001

Related U.S. Application Data

(60) Provisional application No. 60/189,695, filed on Mar. 15, 2000.

(51) Int. Cl.[7] ..... H05B 3/68

(52) U.S. Cl. ..... 219/460.1

(58) Field of Search ..... 219/451.1, 415.11, 219/455.11, 456.1, 460.1, 461.1; 126/39 H, 393, 90 A, 92 AC, 92 A, 92 B

(56) References Cited

U.S. PATENT DOCUMENTS

| | | | | | |
|---|---|---|---|---|---|
| 3,345,498 | A | * | 10/1967 | Siegla | 219/461.1 |
| 3,346,721 | A | * | 10/1967 | Bassett, Jr. | 219/460.1 |
| 3,501,621 | A | * | 3/1970 | Pansing et al. | 219/460.1 |
| 3,612,827 | A | * | 10/1971 | Dills | 219/455.11 |
| 3,646,321 | A | * | 2/1972 | Siegla | 219/465.1 |
| 3,686,477 | A | | 8/1972 | Dills et al. | 219/464 |
| 3,833,793 | A | * | 9/1974 | McWilliams et al. | 219/461.1 |
| 4,032,750 | A | | 6/1977 | Hurko | 219/464 |
| 4,237,368 | A | | 12/1980 | Welch | 219/449 |
| 4,453,533 | A | * | 6/1984 | Scheidler et al. | 219/452.12 |
| 5,185,047 | A | * | 2/1993 | Ray | 126/39 H |
| 5,220,155 | A | * | 6/1993 | Cunningham | 219/448.11 |
| 5,317,129 | A | * | 5/1994 | Taplan et al. | 219/452.12 |
| 5,935,469 | A | | 8/1999 | Deo et al. | 219/458 |
| 5,954,981 | A | | 9/1999 | Deo et al. | 219/455.11 |
| 5,968,391 | A | | 10/1999 | Deo et al. | 219/460.1 |
| 5,977,524 | A | | 11/1999 | Deo et al. | 219/461.1 |
| 5,994,674 | A | * | 11/1999 | Carter | 219/452.11 |

OTHER PUBLICATIONS

Datasheet, Superwool® 607 and 612, Thermal Ceramics, Sep. 1999.

* cited by examiner

*Primary Examiner*—Sang Paik
(74) *Attorney, Agent, or Firm*—Howrey Simon Arnold & White, LLP

(57) ABSTRACT

A modular radiant heating unit adapted for installation into a cooktop or the like. In one embodiment, the heating unit comprises an open-topped pan having a bottom and circumferential sidewall defining a flanged upper rim. A thermally insulating support element disposed in the bottom of the pan, and a radiant heating element is disposed in a pattern on the support element. An insulation ring is extends around and adjacent to the inner surface of the circumferential sidewall of the pan. A thermally insulating washer-like gasket is disposed atop the insulation ring and the flanged upper rim of the pan. A glass-ceramic cover plate is disposed atop the gasket, such that the gasket enhances the seal between the plate and the pan. The present invention also includes methods of assembling a modular radiant heating unit having such a gasket.

31 Claims, 4 Drawing Sheets

MODULAR RADIANT HEATING UNIT HAVING A THERMALLY INSULATING GASKET AND METHODS OF ASSEMBLING SAME

The present application claims priority from Provisional Application Ser. No. 60/189,695 entitled "Modular Radiant Heating Unit" filed Mar. 15, 2000, commonly owned by the assignee of the present invention and incorporated herein by reference in its entirety.

FIELD OF THE INVENTION

This invention relates generally to the field of electric heating units, and more particularly relates to radiant heating units for use in ranges or cooktop units.

BACKGROUND OF THE INVENTION

In U.S. Pat. No. 5,968,391 to Deo et al, entitled "Modular Electric Heating Unit," there is disclosed a radiant heater unit usable as a replacement part for conventional tubular coil heating units commonly found in residential stoves and cooktop units. The heater disclosed in the Deo '391 patent incorporates a resistive wire radiant heating element within a pan defining the bottom and sides of the module unit. A heat-conductive glass cover or top is disposed over the radiant heating element in a spaced relationship, defining a cavity of air within the pan. In one embodiment, the modular heating unit is adapted for installation in a "drop-in" manner, such that it may be utilized both in original equipment or as a replacement for a conventional coil-type tubular stovetop heating element. The Deo '391 patent is commonly assigned to the assignee of the present invention, and is hereby incorporated by reference herein in its entirety.

In U.S. Pat. No. 5,954,981 to Deo et al., entitled "Mounting Apparatus for Modular Radiant Heating Element," there is disclosed a bracket for mounting a modular radiant heating element within an opening in a cooktop. The Deo '981 patent is also commonly assigned to the assignee of the present invention and is also incorporated by reference herein in its entirety.

In the Deo '391 patent, the resistive wire radiant heating element is disposed upon a cake of microporous insulating material disposed on the bottom surface of the pan in a desired serpentine pattern. U.S. Pat. No. 5,935,469 to Deo et al., entitled "Insulating Staple for Holding the Resistive Member of a Heating Element in Place," and U.S. Pat. No. 5,977,524 to Deo et al., entitled "Microwire Staple for Holding the Resistive Member of a Heating Element in Place," each disclose the use of small-diameter staples to hold the resistive wire in place atop the insulating cake. The Deo '469 and '524 patents are commonly assigned to the assignee of the present invention and are hereby incorporated by reference herein in their respective entireties.

Modular radiant heating elements such as that disclosed in the above-referenced Deo '391 patent are believed to offer significant advantages over prior radiant cooktop designs. One significant advantage is that in many radiant cooktop implementations, a single piece of glass extends over the entire surface area of the cooktop. If the glass in such implementations is damaged, the entire cooktop surface must be replaced. With the modular units disclosed in the Deo '391 patent, each heating element is separately and independently serviceable. The modular design proposed in the '391 patent further advantageously allows the heating elements to be retrofitted into existing stoves or ranges, replacing the conventional coiled tubular elements often found in such units.

Notwithstanding the perceived advantages of the radiant heater technology disclosed in the various above-referenced patents, it is believed that there is room for even further improvements and developments in this radiant heater technology. One issue relates to the thermal efficiency of radiant heaters. In particular, it is desirable for the heat radiating from the heater wire to be directed as much as possible directly upward toward the glass cover. Heat dissipated out of the sides or bottom of the heating unit will undesirably reduce the unit's overall efficiency.

Another consideration relates to durability of the glass top of the heating unit. To qualify for certain safety and quality ratings (for example, certification by Underwriter's Laboratories), a modular heating element must be able to withstand physical stresses up to some extent. For example, in the case of glass-topped cooktops, one test is UL 858 Section 71.3 that involves dropping a steel sphere, 2 inches in diameter and weighing 1.18 lbs., from 20.25 inches above the cooktop.

The present invention is directed to overcoming, or at least reducing the effects of, one or more of the problems set forth above.

SUMMARY OF THE INVENTION

In view of the foregoing considerations, the present invention is directed to a modular heating element constructed so as to maximize its thermal efficiency and resistance to breakage.

To this end, the present invention includes a modular radiant heating unit having a pan, a radiant heating element, a thermally insulating support element, an insulation ring, a glass-ceramic plate, and a thermally insulating gasket. The pan has a bottom and a circumferential sidewall. The circumferential sidewall has a flanged upper rim. The radiant heating element is disposed on the thermally insulating support element that rests on the bottom of the pan. The insulation ring extends around the inner surface of the circumferential sidewall. The thermally insulating gasket is disposed beneath the glass-ceramic plate and between the plate and the flanged upper rim.

The gasket functions to minimize radial heat dissipation, thereby minimizing thermal stress on the sealant used to affix the plate to the pan defining the body of the heating unit. The gasket is readily compressible, such that when pressed against the dimpled underside of the glass cover plate on its top side and against the insulation ring on its bottom side, the gasket readily conforms itself simultaneously to both of these surfaces and provides an easily-developed seal to minimize heat loss across those surfaces. Moreover, the gasket makes the heating unit more durable by serving as a cushion between the plate and the pan as well as the more rigid insulation ring.

In another embodiment, the present invention includes a heating unit adapted to be installed in a cooktop. The heating unit includes a pan, a thermally insulating support element, an insulation ring, and a thermally insulating gasket. The pan has a bottom and a circumferential sidewall. The thermally insulating support element is disposed on the bottom of the pan. The heating element generates heat and is disposed on the thermally insulating support and beneath a glass-ceramic cooking plate. The insulation ring extends around the inner surface of the circumferential sidewall. The thermally insulating gasket is disposed beneath the glass-ceramic cooking plate and between the glass-ceramic cooking plate and the insulation ring.

The present invention further includes a method of assembling a modular radiant heating unit. The method includes the steps of: disposing a thermally insulating support element in a bottom of an open-topped pan having a circumferential sidewall and a flanged upper rim; disposing a radiant heating element in a pattern upon the insulating support element; disposing an insulation ring in the pan so as to extend around and adjacent to the circumferential sidewall; disposing a thermally insulating washer-like gasket upon the insulation ring; and disposing a glass-ceramic plate having an upper surface defining a cooktop over the open top of the pan such that the gasket is disposed between the plate and the insulating ring and between the plate and the flanged upper rim. The method may further include the steps of introducing a thermal sealant between the plate and the flanged upper rim adjacent to the gasket and applying compressive pressure upon an upper surface of the plate, thereby compressing the gasket between the plate and the insulation ring and between the plate and the flanged upper rim.

BRIEF DESCRIPTION OF THE DRAWINGS

The foregoing and other features and aspects of the present invention will be best understood with reference to the following detailed description of a specific embodiment of the invention, when read in conjunction with the accompanying drawings, wherein.

Figure 1:
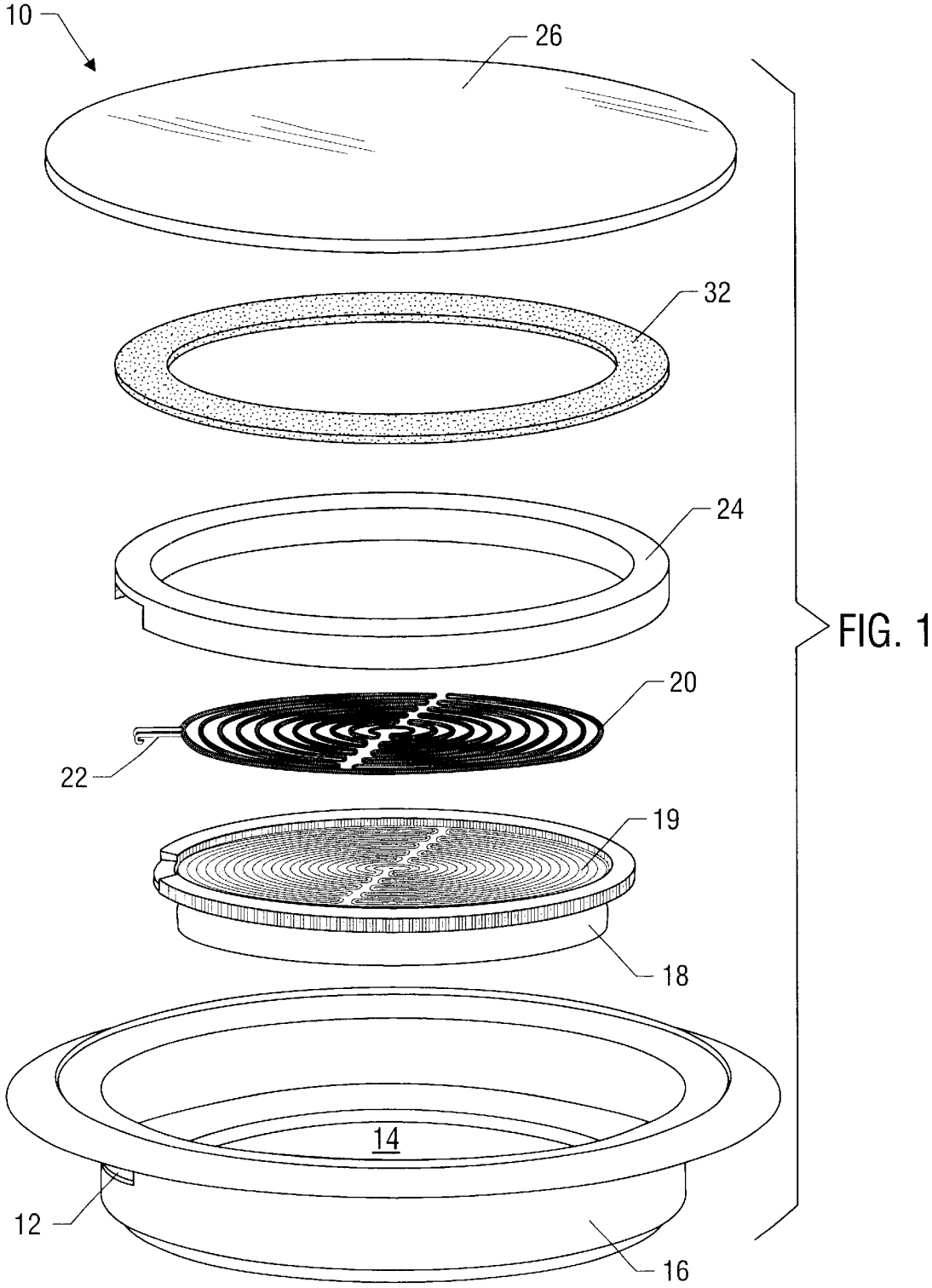
FIG. 1 is an exploded perspective view of a modular radiant heating unit in accordance with one embodiment of the invention.

While the invention is susceptible to various modifications and alternative forms, certain specific embodiments thereof have been shown by way of example in the drawings and will be described in detail. It should be understood, however, that the intention is not to limit the invention to the particular forms described. On the contrary, the intention is to cover all modifications, equivalents, and alternatives falling within the spirit and scope of the invention as defined by the appended claims.

DESCRIPTION OF ILLUSTRATIVE EMBODIMENTS

Illustrative embodiments will now be described with reference to the accompanying figures. Turning to the drawings, FIG. 1 is an exploded perspective view of a modular radiant heater unit 10 in accordance with one embodiment of the invention. Modular radiant heater 10 is shown in a cross-sectional side view in FIG. 2 and in side view in FIG. 3. In the presently disclosed embodiment, radiant heater 10 comprises an open-topped pan 12 having a bottom 14 and a circumferential sidewall 16. Pan 12 may be made of metal, for example, aluminized steel or the like. As used herein, the term "modular" is intended to refer to the ability of an individual heater unit 10 to be used as a readily assembled and replaceable unit in any appropriately-sized aperture. In particular, in one embodiment, the heater unit 10 is adapted to be to be readily installed in a "drop-in" fashion in essentially any appropriately-sized aperture, such as the cut-outs found on conventional residential stovetop.

Disposed upon bottom 14 of pan 12 is a thermally insulating support element 18 adapted to support a radiant heating element 20 thereon. In one embodiment, insulating support element comprises a cake of microporous insulating material, for example, pressed ceramic fiber. One material suitable for the purposes of practicing the present invention is a fibrous refractory ceramic combined with fumed silica material. Such material is commercially-available under the name WDS Insulation from Wacker Chemie, Kempten, Germany, which material is rated to withstand temperatures of 1200° C. or so, although it is believed that other materials may be equally suitable for the purposes of practicing the present invention.

Radiant heating element 20 in the presently preferred embodiment is a coiled resistive wire, although it is contemplated that the present invention may be advantageously practiced using other types of radiant heating elements, including without limitation tubular heating elements and ribbon heating elements. In any case, heating element 20 is adapted to receive electrical power at terminals 22 thereof in a conventional manner. In one embodiment, terminals 22 are configured so as to be compatible with the terminals of a conventional coiled tubular cooktop heating element, such that modular heating element 10 can be retrofitted into existing residential or commercial electric ranges or stoves. Although terminals 22 in the presently disclosed embodiment extend substantially radially outward through sidewall 16 of pan 12, it is contemplated in other embodiments that terminals 22 may be configured to project downward and out through bottom 14 of pan 12, either at or near sidewall 16 or more or less at the center of bottom 14; the particular configuration of terminals 22 is not believed to be particularly critical to the practice of the present invention, and it is believed that those of ordinary skill in the art having the benefit of the present disclosure will be readily able to adapt the disclosed embodiment to particular applications insofar as the configuration of terminals 22 is concerned.

Likewise, from FIG. 1, it is apparent that insulating support element 18 is provided with a pattern of grooves 19 therein and that coiled heating element 20 is configured to conform with that pattern so as to optimize the uniformity of heat generation by heating element 20. Although a particular pattern of grooves 19 and a corresponding configuration of heating element 20 is depicted in the Figures, such particular pattern is not believed to be critical for the purposes of the present invention, and it is believed that those of ordinary skill in the art having the benefit of this disclosure would be readily able to adopt different configurations for heating element 20 and corresponding grooves 19 in insulating support element 18. As would be apparent to those of ordinary skill in the art, it may be necessary to modify the pattern of grooves 19 and the corresponding configuration of heating element 20 depending upon the desired external location of terminals 22 in a given application.

In one embodiment, heating element 20 is secured to insulating support element 18 by means of microwire staples (not shown in the Figures) inserted downwardly into insulating support element 18. Such an arrangement is disclosed in detail in the above-referenced Deo '469 and '524 patents. The particular manner in which heating element 20 is secured to support element 18 is not believed to be critical for the purposes of practicing the present invention, and it is contemplated that other means for securing may be employed.

Figure 2:
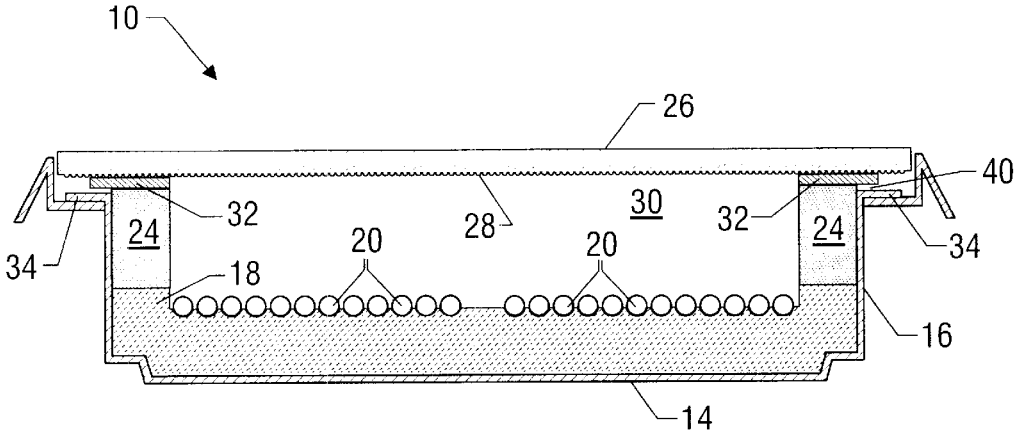
FIG. 2 is a side cross-sectional view of the modular radiant heating unit from FIG. 1.
Figure 3:
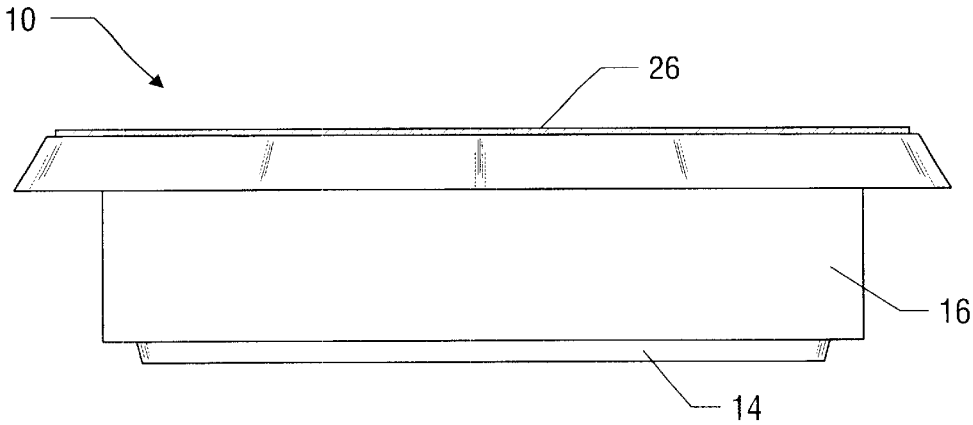
FIG. 3 is a side view of the modular radiant heating unit from FIG. 1.
Figure 4:
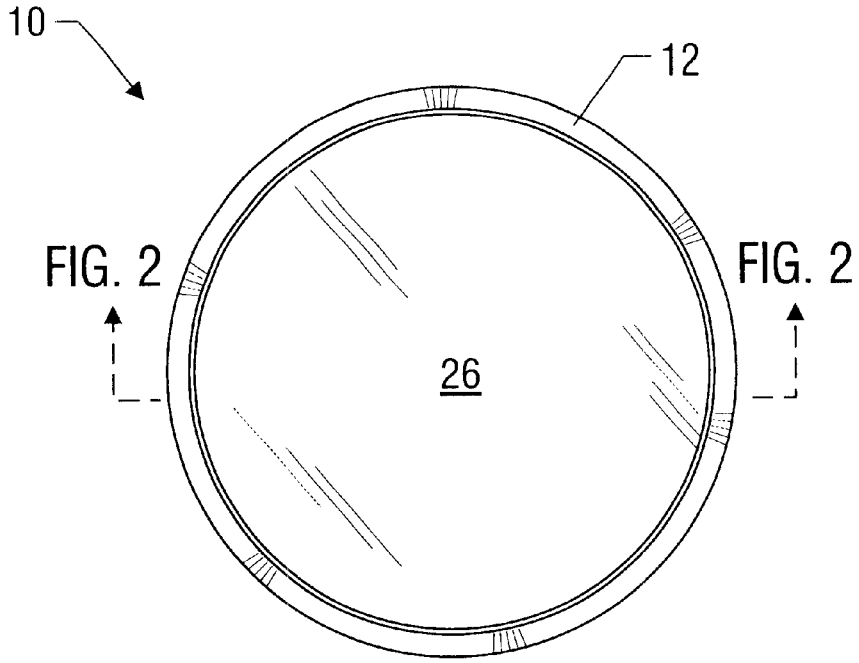
FIG. 4 is a top view of the modular radiant heating unit from FIG. 1.
Figure 5:
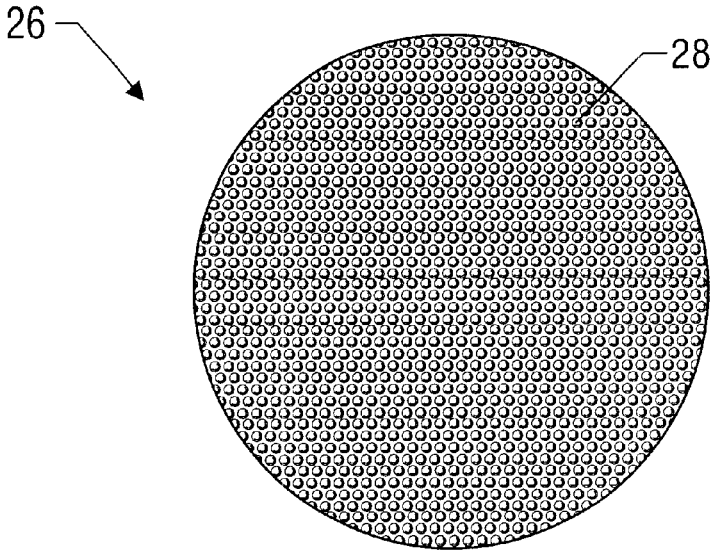
FIG. 5 is a bottom view of a glass-ceramic cover from the modular radiant heating unit from FIG. 1.

With continued reference to both FIG. 1 and FIG. 2, an insulation ring 24 extends around the inner circumference of pan 12, adjacent to pan sidewall 16. Among other functions, the insulation ring 24 serves to minimize radiation of heat radially outward through sidewall 16, and further serves as a support structure for a glass-ceramic cover 26 defining the upper surface of modular radiant heater 10. In one embodiment, the insulation ring is made of Superwool 612 or RPC2100 from Thermal Ceramics in Augusta, Ga. In the disclosed embodiment, insulation ring 24 is relatively rigid and non-compliant.

Referring to FIGS. 1, 2, 4, and 5, a glass-ceramic plate 26 defines the cover plate of modular radiant heating element 10. In the presently preferred embodiment, plate 26 is made of glass-ceramic or other compositions possessing the desirable qualities of strength, impact resistance, thermal resistance and thermal conductivity. In addition to functioning as the cooktop upon which food or cooking utensils are placed during cooking, cover plate 26 further cooperates with pan 12 to create a sealed cavity 30 having heating element 20 and insulating support element 18 disposed at a bottom thereof. In the prior art, as exemplified by the above-referenced Deo '391 patent, plate 26 is secured over the open top of pan 12 by means of a suitably thermally-resistant sealant material, such as RTV sealant or the like.

Those of ordinary skill in the art will appreciate that as an artifact of the prevalent methods of manufacturing glass-ceramic, plate 26 has a textured or dimpled undersurface 28. One potential disadvantage of the dimpled undersurface 28 is that it can diminish the integrity of the seal established between plate 26 and ring 24. Those of ordinary skill in the art will appreciate that imperfections in this seal can adversely impact the thermal efficiency of radiant heating unit 10, and can in more extreme cases lead to infiltration of moisture or other foreign substances into cavity 30, possibly resulting in premature failure of heating element 20, for example, through oxidation.

To address the issue of sealing cavity 30, and in accordance with an important aspect of the present invention, in the preferred embodiment a washer-like gasket 32 is provided between plate 26 and the components beneath plate 26. In one embodiment, gasket 32 is composed of a relatively compressible or compliant, thermally insulative material, such as a blanket of ceramic fiber material. In one embodiment, the gasket 32 is made of K-Shield BF Paper from Thermal Ceramics in Augusta, Ga. As can be particularly observed in FIG. 2, gasket 32 is substantially coaxial with ring element 24 and extends over a flanged rim 34 of pan 12.

Figure 6:
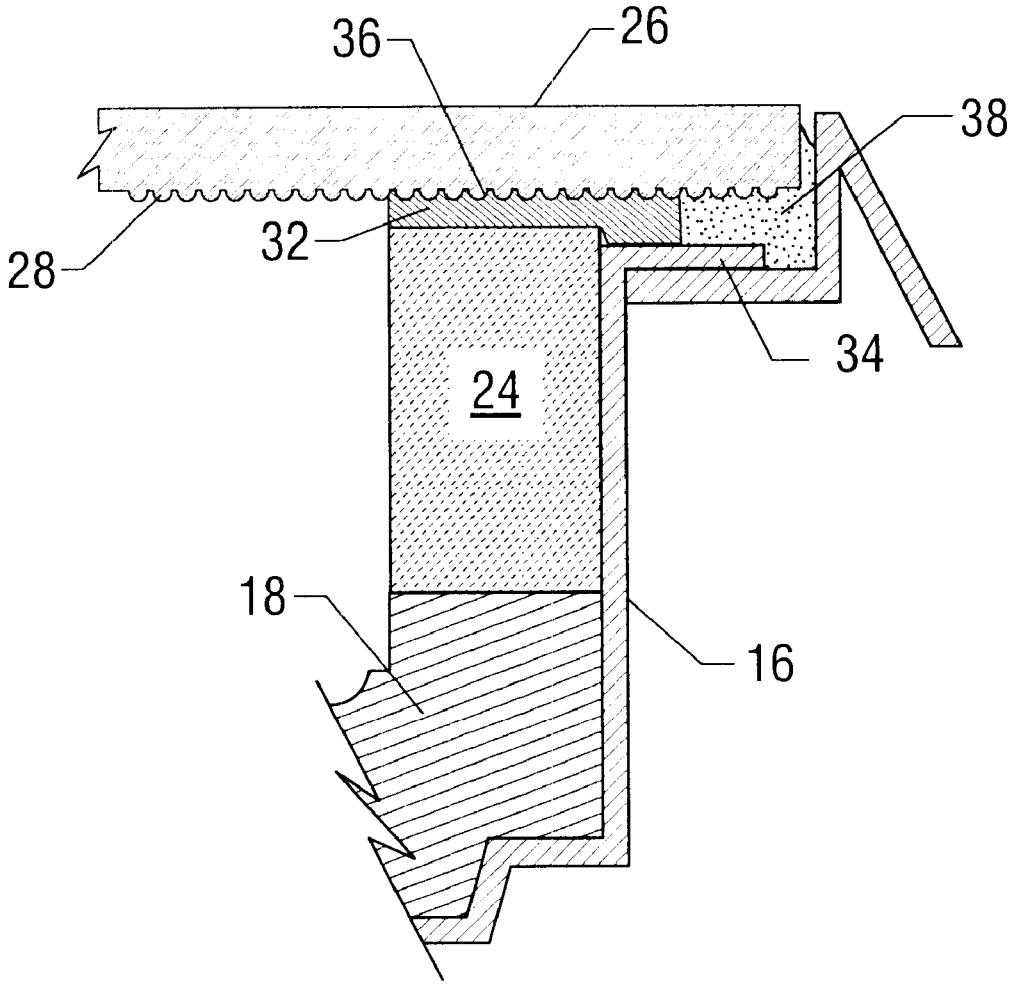
FIG. 6 is an enlarged cross-sectional view of a perimeter section of the modular radiant heating unit from FIG. 1.

FIG. 6 is an enlarged cross-sectional view of a perimeter portion of modular radiant heating unit 10 showing an interface 36 between plate 26 and gasket 32. As can be seen in FIG. 6, due to the relative compliance of gasket 32, the dimpling of undersurface 28 of plate 26 effectively contributes to the integrity of the sealing of chamber 30. Gasket 32 is preferably also relatively compliant relative to ring element 24, further enhancing the seal.

With continued reference to FIG. 6. It is contemplated that a manufacturing process for modular radiant heating unit 10 will involve the introduction of a curable sealant 38, such as RTV sealant, around the perimeter of plate 26, followed by application of downward pressure on plate 26 during a period in which sealant 38 is allowed to set. It is to be understood that the cross-sectional view of FIG. 2 shows the various components of modular radiant heating unit 10 prior to complete assembly, and in particular, prior to the application of downward pressure on plate 26. In this state, as can be observed in FIG. 2, it is possible that a small gap 40 may exist between gasket 32 and rim 34 of pan 12, resulting from the height of insulation ring 24 being somewhat greater than the height of sidewall 16. Upon introduction of sealant 38 and application of downward pressure on plate 26, the resulting configuration is as shown in FIG. 6. In one embodiment, ring element 24 is relatively more rigid than insulating support element 18, such that application of pressure on plate 26 will cause some compression of support element 18, thereby eliminating gap 40.

In addition to contributing to the integrity of the seal of plate 26 over pan 12, gasket 32 also advantageously improves the thermal efficiency of modular radiant heating unit 10, through minimization of heat dissipation radially outward from the perimeter. As a result of its insulative effect, thermal stresses on sealant 38 is reduced. Moreover, the relative pliancy of gasket 32 can advantageously contribute to the durability of heating unit 10, in that gasket 32 can serve as a cushion to some degree between plate 26 and both rim 34 of pan 12 as well as the relatively more rigid insulation ring 24. This is important as it increases the ability of the heating unit to pass certain safety and quality ratings discussed above in the background section.

In one embodiment of the invention, a thermal sensor (not shown in the Figures) is disposed within cavity 30 of heating unit 10, in order that the power supplied to heating element 20 may be modulated as necessary to maintain the temperature within cavity 30 at a desired level. Such a thermal sensor may be introduced through bottom 14 or sidewall 16 of pan 12. Such an arrangement is described in the above-referenced Deo '391 patent.

As noted above, the modularity of heating unit 10 as disclosed herein enables heating unit 10 to be installed in essentially any appropriately-sized aperture. In one embodiment, heating unit 10 may be adapted to function as a replacement part for an existing stove having removable coil-type tubular heating elements therein. Alternatively, heating unit 10 may be incorporated into new or customized stove-top designs. Thus, while a conventional residential stove-top typically has four heating elements arranged in an essentially symmetric matrix, appropriately-sized apertures may be formed in any suitable countertop-like surface in essentially any customizable configuration and pattern.

From the foregoing detailed description of a specific embodiment of the invention, it should be apparent that an improved modular radiant heater has been disclosed which is constructed in such a way as to improve both its physical and thermal performance. Although a specific embodiment of the invention has been disclosed herein in some detail, this has been done solely for the purposes of illustrating various aspects and features of the invention, and is not intended to be limiting with respect to the scope of the invention. It is contemplated that various substitutions, alterations, modifications and/or additions, including but not limited to those design alternatives which might have been specifically noted in this disclosure, may be made to the disclosed embodiment without departing from the spirit and scope of the invention as defined in the appended claims.

What is claimed is:

1. A. modular radiant heating unit, comprising:

a pan having a bottom and a circumferential sidewall, the circumferential sidewall having a flanged rim;

a radiant heating element disposed upon a thermally insulating support element adapted to be received at the bottom of the pan;

an insulation ring extending around an inner surface of the circumferential sidewall;

a glass-ceramic plate, the top surface of which defining a cooktop; and a thermally insulating washer-like gasket disposed beneath the plate and between the plate and the flanged rim;

wherein the gasket extends between the plate and the insulation ring.

2. A modular radiant heating unit in accordance with claim 1, wherein a bottom surface of the plate is dimpled.

3. A modular radiant heating unit in accordance with claim 1, wherein the gasket is relatively more compliant than the insulation ring.

4. A modular radiant heating unit in accordance with claim 3, wherein the gasket is made of ceramic fibrous material.

5. A modular radiant heating unit in accordance with claim 1, wherein the insulation ring is made of Superwool® 612.

6. A modular radiant heating unit in accordance with claim 1, further comprising a thermal sealant disposed between the plate and the flanged rim adjacent to the gasket around a perimeter of the plate.

7. A modular radiant heating unit in accordance with claim 1, wherein the heating element is a coiled resistive wire.

8. A heating unit adapted to be installed in a cooktop, the heating unit comprising:

a pan having a bottom and a circumferential sidewall, a thermally insulating support element disposed on the bottom of the pan;

a heating element to which an electric current is applied to generate heat, the heating element being disposed on the thermally insulating support element and beneath a glass-ceramic cooking plate;

an insulation ring extending around an inner surface of the circumferential sidewall; and a thermally insulating washer-like gasket disposed beneath the glass-ceramic cooking plate and between the glass-ceramic cooking plate and the insulation ring;

wherein the circumferential sidewall has a flanged rim, the gasket extending between the glass-ceramic cooking plate and the flanged rim.

9. A heating unit in accordance with claim 8, wherein a bottom surface of the glass-ceramic cooking plate is dimpled.

10. A heating unit in accordance with claim 8, wherein the gasket is relatively more compliant than the insulation ring.

11. A heating unit in accordance with claim 10, wherein the gasket is made of ceramic fibrous material.

12. A heating unit in accordance with claim 8, wherein the insulation ring is made of Superwool® 612.

13. A heating unit in accordance with claim 8, further comprising a thermal sealant disposed between the glass-ceramic cooking plate and the flanged rim adjacent to the gasket around a perimeter of the plate.

14. A heating unit in accordance with claim 8, wherein the heating element is a coiled resistive wire.

15. A method of assembling a modular radiant heating unit, comprising:

(a) disposing a thermally insulating support element in a bottom of an open-topped pan having a circumferential sidewall and a flanged upper rim;

(b) disposing a radiant heating element in a pattern upon the insulating support element;

(c) disposing an insulation ring in the pan so as to extend around and adjacent to the circumferential sidewall;

(d) disposing a thermally insulating washer-like gasket upon the insulation ring;

(e) disposing a glass-ceramic plate having an upper surface defining a cooktop over the open top of the pan such that the gasket is disposed between the plate and the insulation ring and between the plate and the flanged upper rim.

16. A method in accordance with claim 15, wherein the method further comprises the step of introducing a thermal sealant between the plate and the flanged upper rim adjacent to the gasket.

17. A method in accordance with claim 16, wherein the method further comprises the step of applying compressive pressure upon an upper surface of the plate, thereby compressing the gasket between the plate and the insulation ring and between the plate and the flanged upper rim.

18. A method in accordance with claim 16, wherein the gasket is made of ceramic fibrous material.

19. A modular radiant heating unit, comprising:

a pan having a bottom and a circumferential sidewall, the circumferential sidewall having a flanged rim;

a radiant heating element disposed upon a thermally insulating support element adapted to be received at the bottom of the pan;

an insulation ring extending around an inner surface of the circumferential sidewall;

a glass-ceramic plate, the top surface of which defining a cooktop;

a thermally insulating washer-like gasket disposed beneath the plate and between the plate and the flanged rim; and a thermal sealant disposed between the plate and the flanged rim adjacent to the gasket around a perimeter of the plate.

20. A modular radiant heating unit in accordance with claim 19, wherein the gasket extends between the plate and the insulation ring.

21. A modular radiant heating unit in accordance with claim 19, wherein a bottom surface of the plate is dimpled.

22. A modular radiant heating unit in accordance with claim 19, wherein the gasket is relatively more compliant than the insulation ring.

23. A modular radiant heating unit in accordance with claim 22, wherein the gasket is made of ceramic fibrous material.

24. A modular radiant heating unit in accordance with claim 19, wherein the insulation ring is made of Superwool® 612.

25. A modular radiant heating unit in accordance with claim 19, wherein the heating element is a coiled resistive wire.

26. A heating unit adapted to be installed in a cooktop, the heating unit comprising:

a pan having a bottom and a circumferential sidewall;

a thermally insulating support element disposed on the bottom of the pan;

a heating element to which an electric current is applied to generate heat, the heating element being disposed on the thermally insulating support element and beneath a glass-ceramic cooking plate;

an insulation ring extending around an inner surface of the circumferential sidewall;

a thermally insulating washer-like gasket disposed beneath the glass-ceramic cooking plate and between the glass-ceramic cooking plate and the insulation ring, the circumferential sidewall has a flanged rim, the gasket extending between the glass-ceramic cooking plate and the flanged rim; and a thermal sealant disposed between the glass-ceramic cooking plate and the flanged rim adjacent to the gasket around a perimeter of the plate.

27. A heating unit in accordance with claim 26, wherein a bottom surface of the glass-ceramic cooking plate is dimpled.

28. A heating unit in accordance with claim 26, wherein the gasket is relatively more compliant than the insulation ring.

29. A heating unit in accordance with claim 28, wherein the gasket is made of ceramic fibrous material.

30. A heating unit in accordance with claim 26, wherein the insulation ring is made of Superwool® 612.

31. A heating unit in accordance with claim 28, wherein the heating element is a coiled resistive wire.

* * * * *